US008225807B1

(12) United States Patent
Cain

(10) Patent No.: US 8,225,807 B1
(45) Date of Patent: Jul. 24, 2012

(54) COLLAPSIBLE EXTERNAL SHADE SYSTEM FOR VEHICLES

(76) Inventor: Kendel C. Cain, Miami, FL (US)

( * ) Notice: Subject to any disclaimer, the term of this patent is extended or adjusted under 35 U.S.C. 154(b) by 98 days.

(21) Appl. No.: 12/914,293

(22) Filed: Oct. 28, 2010

(51) Int. Cl.
*E04H 15/08* (2006.01)
*E04F 10/06* (2006.01)

(52) U.S. Cl. ..... 135/88.07; 135/88.12; 135/88.14; 296/163; 160/67

(58) Field of Classification Search ..... 135/88.01, 135/88.05, 88.07, 88.11, 88.12, 88.14; 296/156, 296/158, 159, 163, 168; 160/66–67
See application file for complete search history.

(56) References Cited

U.S. PATENT DOCUMENTS

| | | | | |
|---|---|---|---|---|
| 2,513,411 | A * | 7/1950 | Heil | 296/161 |
| D220,478 | S | 4/1971 | Shelton | |
| 3,741,274 | A * | 6/1973 | Youngblood, Jr. | 160/23.1 |
| 3,847,171 | A | 11/1974 | Akers et al. | |
| 4,519,409 | A * | 5/1985 | Kinney et al. | 135/88.08 |
| 4,993,773 | A * | 2/1991 | Lange | 296/160 |
| 5,172,743 | A * | 12/1992 | Wallace et al. | 160/67 |
| 6,021,835 | A * | 2/2000 | Malott | 160/67 |
| 6,095,221 | A | 8/2000 | Frey, Jr. | |
| 6,494,246 | B1 * | 12/2002 | Blevins | 160/67 |
| 6,782,936 | B1 | 8/2004 | Girard et al. | |
| 7,059,660 | B1 * | 6/2006 | Juola | 296/163 |
| 7,364,050 | B2 | 4/2008 | Guard | |
| 2005/0072532 | A1 | 4/2005 | Holden et al. | |
| 2006/0124164 | A1 * | 6/2006 | Pacheco | 135/88.05 |

* cited by examiner

*Primary Examiner* — Winnie Yip

(57) ABSTRACT

A shade system for mounting atop a vehicle. The system features a first support panel attachable flush with the top of the vehicle via an attachment means and a second support panel pivotally attached to the first support panel. The second support panel can pivot from atop the first support panel to a vertical position perpendicular to the first support panel via a hydraulic arm. A shade housing is disposed atop the second support platform. A shade component is rolled on a spool in the shade housing. The shade component can be extended from and retracted into the shade housing. The shade component can be stabilized to keep the shade component in an extended position via a securing means.

10 Claims, 3 Drawing Sheets

COLLAPSIBLE EXTERNAL SHADE SYSTEM FOR VEHICLES

FIELD OF THE INVENTION

The present invention is directed to a vehicle accessory, more particularly to a collapsible external shade for mounting to a vehicle and providing shade to a user when desired.

BACKGROUND OF THE INVENTION

It can be difficult to find shade when traveling in one's vehicle, for example on a trip, camping, or any other activity. The present invention features a collapsible external shade system for mounting to a vehicle. The shade system of the present invention provides shade at the touch of a button and allows a user to have access to shade at any time Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a collapsible external shade system for mounting to a vehicle. In some embodiments, the collapsible external shade system comprises a first support panel having a top surface and a bottom surface; an attachment means disposed on the bottom surface of the first support platform, the attachment means functions to mount the first support platform to a top of a vehicle such that the first support panel is generally flush with the top of said vehicle; a second support panel pivotally attached to a first side edge of the first support panel via a pivot mechanism, the second support panel can pivot between multiple positions including a horizontal position wherein the second support panel is positioned atop the first support panel such that the first support panel and second support panel are generally parallel to each other and a vertical position wherein the second support panel is pivoted away from the first support panel such that the second support panel is generally perpendicular to the first support panel; a hydraulic arm functioning to move the second support panel between the horizontal position and vertical position, a first end of the hydraulic arm is mounted to the top surface of the first support platform and a second end of the hydraulic arm is mounted to a bottom surface of the second support platform, the hydraulic arm is operatively connected to a power source; a shade housing disposed on a top surface of the second support platform between a first side edge and a second side edge of the second support platform, the second side edge being opposite the pivot mechanism; a shade component rolled on a spool disposed in the shade housing, the shade component can be extended from and retracted into the shade housing in a standard manner, wherein an outer edge of the shade component can be stabilized to keep the shade component in an extended position via a securing means; and a control panel operatively connected to the hydraulic arm, the control panel functions to cause the hydraulic arm to move the second support platform between the horizontal position and vertical position.

In some embodiments, one or more footings are disposed on the bottom surface of the first support panel, the footings function to help provide a strong and even fit on the top of the vehicle. In some embodiments, the pivot mechanism is a hinge. In some embodiments, a hydraulic arm housing is disposed in the second support panel, the hydraulic arm housing engages the second end of the hydraulic arm. In some embodiments, the power source is stored in the hydraulic arm housing. In some embodiments, the collapsible external shade system further comprises a support cable spanning from the top surface of the first support platform to the bottom surface of the second support platform.

in some embodiments, the securing means includes one or more support bars. In some embodiments, the support bars extend from the outer edge of the shade component to the second support platform. In some embodiments, the control panel can be remotely accessed via a remote control. In some embodiments, the control panel is disposed on the first support panel, the second support panel, the shade component, or the attachment means.

DESCRIPTION OF PREFERRED EMBODIMENTS

Referring now to FIGS. 1-5, the present invention features a collapsible external shade system 100 for mounting to a vehicle. The shade system 100 of the present invention provides shade at the touch of a button and allows a user to have access to shade at any time.

The shade system 100 of the present invention comprises a first support panel 110 having a top surface and a bottom surface (in some embodiments, a first side edge, a second side edge, a third side edge, and fourth side edge, etc). The first support panel 110 is for mounting to the top of a vehicle, for example a roof rack of a vehicle 101 or the top surface of the vehicle (see FIG. 5), such that the first support panel 110 is generally flush with the top of the vehicle 101. In some embodiments, an attachment means is disposed on the bottom surface of the first support panel 110 for helping to mount the shade system 100 to the vehicle 101. In some embodiments, one or more footings 112 are disposed on the bottom surface of the first support panel 110 for helping to provide a strong and even fit atop the vehicle 101.

Figure 1:
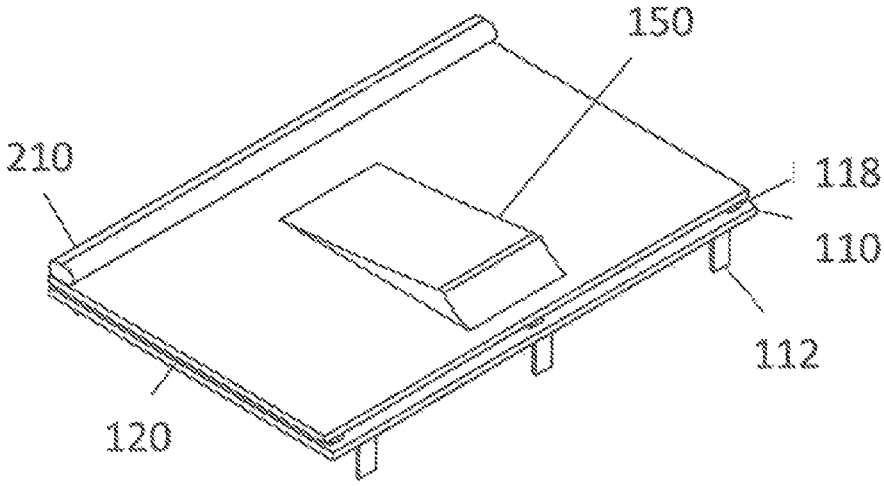
FIG. 1 is a perspective view of the shade system of the present invention.
Figure 2:
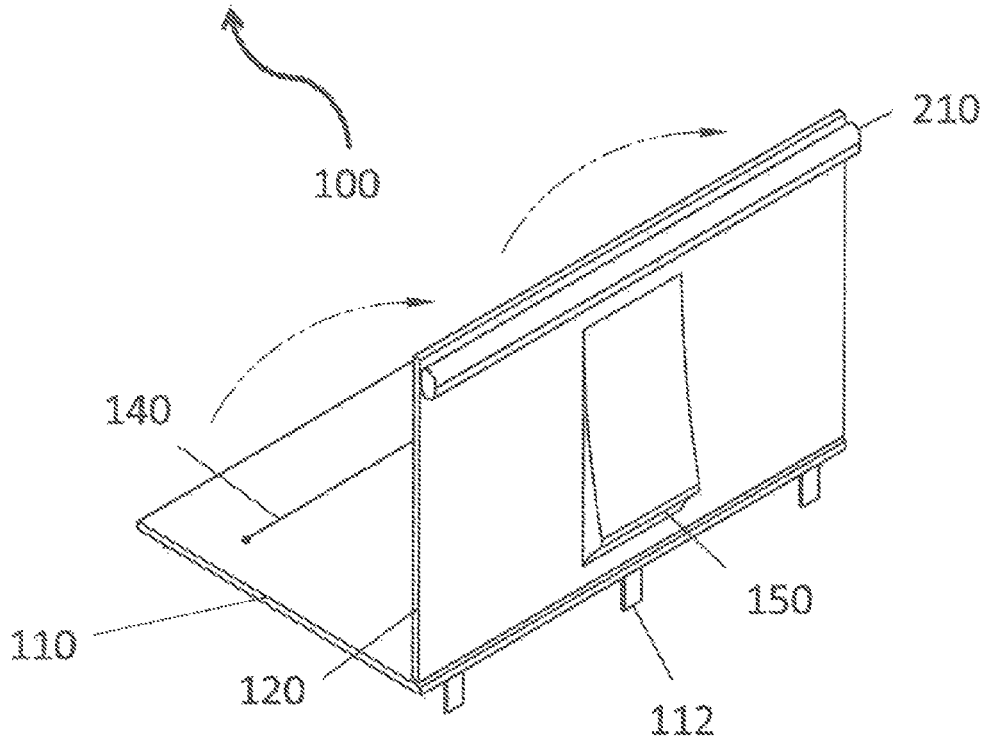
FIG. 2 is a perspective view of the shade system of FIG. 1, wherein the shade system is opening.
Figure 3:
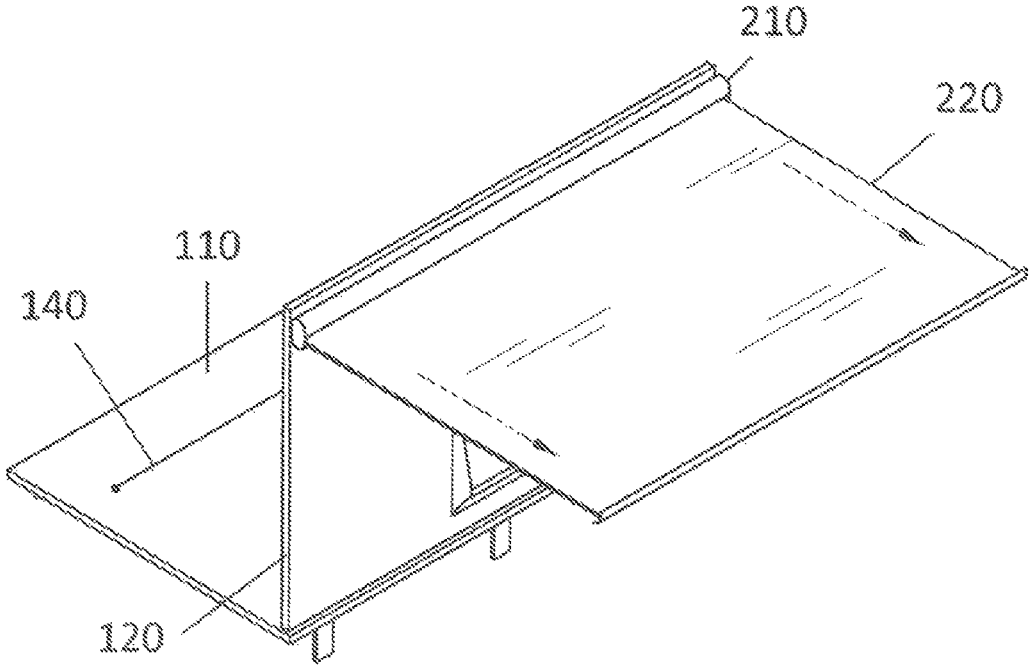
FIG. 3 is a perspective view of the shade system of FIG. 1, wherein the shade system is in the vertical position.
Figure 4:
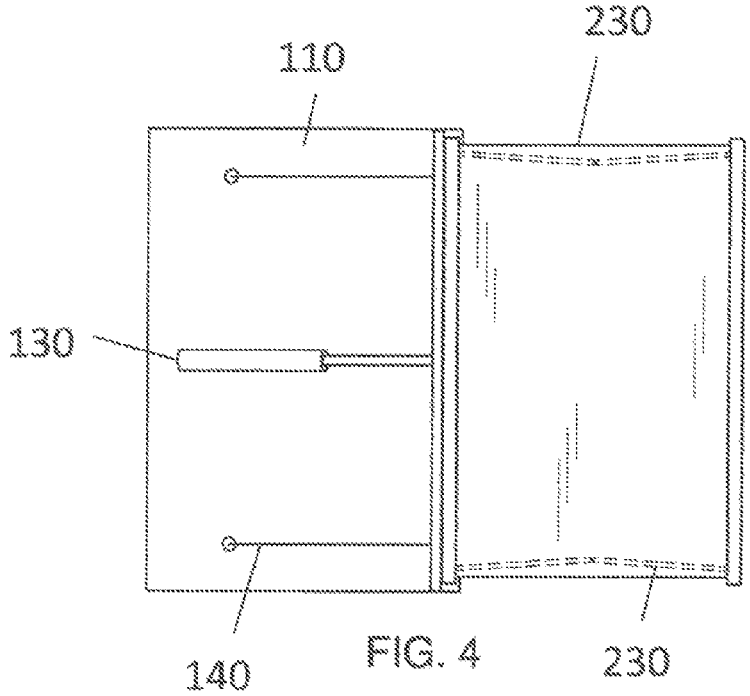
FIG. 4 is a top view of the shade system of FIG. 4.
Figure 5:
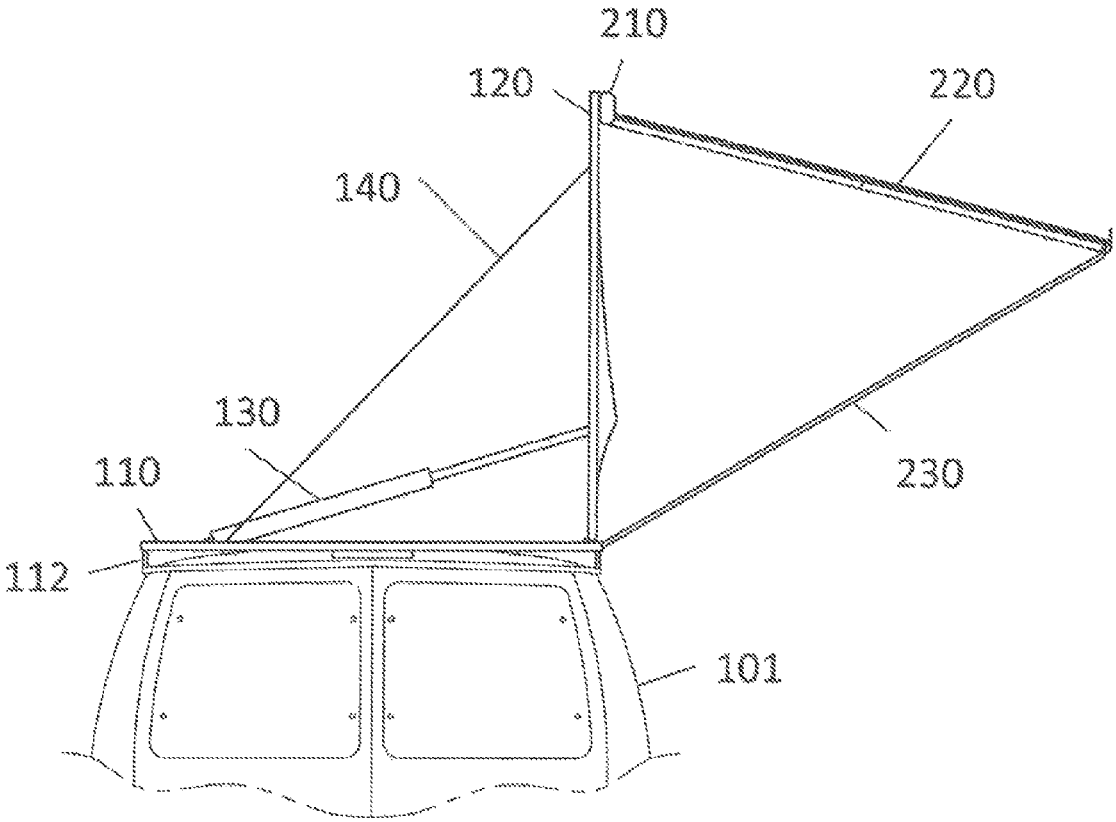
FIG. 5 is an in-use view of the shade system of the present invention.

Pivotally attached (e.g., via a pivot mechanism such as a hinge 118) to the first side edge of the first support panel 110 is a second support panel 120. The second support panel 120 is designed to pivot between multiple positions including but not limited to a horizontal position (e.g., atop the first support panel 110 as shown in FIG. 1) and a vertical position (e.g., opening away from the first support panel 110 as shown in FIG. 2, FIG. 5).

The shade system 100 further comprises a hydraulic arm for moving the second support panel 120 between the horizontal and vertical positions. The first end of the hydraulic arm 130 is mounted to the top surface of the first support platform 110 and the second end of the hydraulic arm 130 is mounted to the bottom surface of the second support platform 120. Hydraulic arms are well known to one of ordinary skill in the art. As shown in FIG. 1, a hydraulic arm housing 150 may be disposed in the second support panel 120, which engages the second end of the hydraulic arm 130. The hydraulic arm 130 is operatively connected to a power source and a control panel. In some embodiments, a power source is stored in the hydraulic arm housing 150.

In some embodiments, one or more support cables 140 span from the top surface of the first support platform 110 to the bottom surface of the second support platform 120 for additional support of the hydraulic arm 130 (e.g., to help prevent the second support platform 120 from pivoting past the vertical position.

Disposed on the top surface of the second support platform 120 along the second side edge (e.g., opposite the hinge 118) or somewhere between the first side edge and the second side edge is a shade housing 210 for housing a shade component 220. The shade component 220 is rolled in the shade housing 210 (e.g. on a spool) such that the shade component 220 can be extended from and retracted into the shade housing 110 (see FIG. 3). Such mechanisms are well known to one of ordinary skill in the art.

The outer edge of the shade component 220 can be stabilized to keep the shade component 220 in an extended position (e.g., providing shade) via a securing means. In some embodiments, the securing means includes one or more support bars. For example, support bars 230 may extend from the outer edge of the shade component 220 to the second support platform 120 (e.g., the first edge near the hinge 118). The present invention is not limited to the aforementioned example of a securing means.

The control panel for operating the hydraulic arm may be remotely accessed (e.g. via a remote control) or the control, panel may be disposed on the shade system 100 such that it is accessible to the user. The control panel causes the hydraulic arm to move the second support platform 120 between the horizontal and vertical positions. Such control panels and functions thereof are well known to one of ordinary skill in the art.

Without wishing to limit the present invention to any theory or mechanism, it is believed that the system 100 of the present invention is advantageous because the system 100 is mountable to the top of the vehicle, allowing for the shade component 220 to have high clearance and provide more shade.

The disclosures of the following U.S. patents are incorporated in their entirety by reference herein: U.S. Pat. Application No. 2005/0072532;. U.S. Pat. No. 3,847,171; U.S. Pat. No. 6,782,936; U.S. Pat. No. 7,364,050; U.S. Pat. No. 6,095,221; U.S. Design Pat. No. D220,478.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A collapsible external shade system comprising:

(a) a first support panel having a top surface and a bottom surface;

(b) an attachment means disposed on the bottom surface of the first support panel, the attachment means functions to mount the first support panel to a top of a vehicle such that the first support panel is generally flush with the top of said vehicle;

(c) a second support panel pivotally attached to a first side edge of the first support panel via a pivot mechanism, the second support panel can pivot between multiple positions including a horizontal position wherein the second support panel is positioned atop the first support panel such that the first support panel and second support panel are generally parallel to each other and a vertical position wherein the second support panel is pivoted away from the first support panel such that the second support panel is generally perpendicular to the first support panel;

(d) a hydraulic arm functioning to move the second support panel between the horizontal position and vertical position, a first end of the hydraulic arm is mounted to the top surface of the first support panel and a second end of the hydraulic arm is mounted to a bottom surface of the second support panel, the hydraulic arm is operatively connected to a power source;

(e) a shade housing disposed on a top surface of the second support panel between a first side edge and a second side edge of the second support panel, the second side edge being opposite the pivot mechanism;

(f) a shade component rolled on a spool disposed in the shade housing, the shade component can be extended from and retracted into the shade housing in a standard manner, wherein an outer edge of the shade component can be stabilized to keep the shade component in an extended position via a securing means; and (g) a control panel operatively connected to the hydraulic arm, the control panel functions to cause the hydraulic arm to move the second support panel between the horizontal position and vertical position.

2. The collapsible external shade system of claim 1, wherein one or more footings are disposed on the bottom surface of the first support panel, the footings function to help provide a strong and even fit on the top of the vehicle.

3. The collapsible external shade system of claim 1, wherein the pivot mechanism is a hinge.

4. The collapsible external shade system of claim 1, wherein a hydraulic arm housing is disposed in the second support panel, the hydraulic arm housing engages the second end of the hydraulic arm.

5. The collapsible external shade system of claim 4, wherein the power source is stored in the hydraulic arm housing.

6. The collapsible external shade system of claim 1 further comprising a support cable spanning from the top surface of the first support platform to the bottom surface of the second support panel.

7. The collapsible external shade system of claim 1, wherein the securing means includes one or more support bars.

8. The collapsible external shade system of claim 7, wherein the support bars extend from the outer edge of the shade component to the second support panel.

9. The collapsible external shade system of claim 1, wherein the control panel can be remotely accessed via a remote control.

10. The collapsible external shade system of claim 1, wherein the control panel is disposed on the first support panel, the second support panel, the shade component, or the attachment means.

* * * * *